United States Patent [19]

Rogers

[11] Patent Number: 4,587,032

[45] Date of Patent: May 6, 1986

[54] DRAIN CLEANER

[75] Inventor: Thomas A. Rogers, Fairport, N.Y.

[73] Assignee: Mobil Oil Corporation, New York, N.Y.

[21] Appl. No.: 668,917

[22] Filed: Nov. 6, 1984

[51] Int. Cl.[4] ..... C11D 17/00

[52] U.S. Cl. ..... 252/174.17; 252/174.21; 252/545; 252/DIG. 14

[58] Field of Search ..... 252/174.17, 174.21, 252/545, DIG. 14, 542, 153

[56] References Cited

U.S. PATENT DOCUMENTS

| | | | |
|---|---|---|---|
| 3,965,048 | 6/1976 | Murtaugh | 252/527 |
| 4,029,607 | 6/1977 | Murtaugh | 252/545 |
| 4,206,068 | 6/1980 | Davis | 252/89.1 |
| 4,409,136 | 10/1983 | Cheng | 252/174.21 |
| 4,485,029 | 11/1984 | Kato et al. | 252/106 |

*Primary Examiner*—Paul Lieberman
*Assistant Examiner*—Willie J. Thompson
*Attorney, Agent, or Firm*—Alexander J. McKillop; Michael G. Gilman; Stanislaus Aksman

[57] ABSTRACT

A drain cleaner composition of reduced toxicity comprises an organic solvent, preferably a water soluble solvent, a surfactant, preferably a fluorosurfactant, a hair decomposer such as a thioglycolate salt, a water soluble salt for increasing the density of the formulation, a thickener to increase the viscosity of the formulation. The composition is preferably formulated as an aqueous solution and other ingredients of reduced toxicity such as accelerators for hair decomposition, corrosion inhibitors, fragrances and dyes may also be included.

11 Claims, No Drawings

DRAIN CLEANER

FIELD OF THE INVENTION

This invention relates to drain cleaners, that is, to materials which are used for cleaning blocked drains by the introduction of a chemical cleaner into the drain.

BACKGROUND OF THE INVENTION

Drains for household sinks often become clogged by a combination of fatty substances, protein or cellulose fibers and soap. Although soap is a good detergent, it has the disadvantage that it reacts with divalent metallic ions in water such as calcium and magnesium, to form an insoluble curd. This curd, together with small amounts of fatty substances such as oil, grease, fatty substances from the body, cooking oils or even hair grooming products, tends to adhere to the inside of the drain and forms a restriction to the free flow of water. In addition, solid, water insoluble products such as hair, lint or paper may become lodged in the drain at the point of restriction so that a relatively immovable plug is eventually formed in the drain.

Most conventional drain cleaners are composed of concentrated solutions of strong acids such as sulfuric acids or of bases such as sodium hydroxide or combinations of strong oxidizing agents with strong bases. Cleaners of this kind attack the clogging material lodged in the drain at the restriction and are generally effective in removing the plug but they have the disadvantage that they are extremely dangerous materials, especially for household use. Each year, a considerable number of accidents occur with drain cleaners of this kind, either from the cleaner being splashed onto the skin or by small children ingesting inadequately guarded quantities of the cleaner. It would therefore be desirable to develop a relatively less toxic cleaner which would still be effective for removing the blockages in most household drains.

Various combinations of chemical ingredients have been proposed for drain cleaners, with different objectives. For example, U.S. Pat. No. 3,965,048 discloses a drain cleaner composition which is stated to be effective in dissolving soap curd and which contains salts of certain polyamine polycarboxylic acids together with other ingredients such as surfactants, and ingredients such as urea and thyoglycolate salts which are effective in dissolving hair and other water insoluble objects. U.S. Pat. No. 4,206,607 also discloses drain cleaner compositions which are effective in dissolving soap curd and which, besides containing salts of certain amino acids and anionic surfactants, may also contain corrosion inhibitors such as thioglycolate salts and materials such as urea which are capable of promoting the dissolution of hair and other insoluble materials. U.S. Pat. No. 4,206,068 discloses drain cleaner compositions which are based on a redox system together with a relatively large amount of a caustic alkali such as sodium hydroxide. Upon use in the drain, the redox system develops a substantial amount of heat upon dissolving in the standing water in the drain and this assists dissolution of hair and fatty substances making up the plug. U.S. Pat. No. 2,997,444 discloses a drain cleaning composition based on caustic alkali and an anticlogging agent such as sodium sulfide or sodium thioglycolate.

We have now developed improved drain cleaner compositions which are relatively less toxic than the drain cleaners which are presently commercially available and yet which are still effective in unplugging drains clogged with soap, grease and hair or other insoluble materials.

SUMMARY OF THE INVENTION

According to the present invention, the drain cleaners comprise the following ingredients in combination:

(i) An organic solvent, (ii) A thioorganic compound which decomposes protein fibers such as hair, (iii) A surfactant, (iv) A water soluble densifying salt, and (v) A water soluble thickener.

In addition, additional materials such as corrosion inhibitors, ingredients such as urea which help to dissolve protein fibers, sequestering agents, corrosion inhibitors, fragrances and dyes for consumer sensory appeal and other conventional adjuvants for drain cleaners may also be present in these formulations.

The drain cleaner's composition is most conveniently formulated for commercial sale as an aqueous solution so that the product may be readily introduced into blocked drains without the necessity for the user to dissolve the various ingredients. Formulation as a solution also ensures homogeneity of composition.

DETAILED DESCRIPTION

The drain cleaners according to the present invention, are compositions which are formulated to be relatively less toxic than currently available drain cleaners and yet are still effective in unplugging drains which are clogged with soap, oil, grease, hair and other protein fibers and possibly other water insoluble materials such as lint or paper. Because the cleaners do not contain any strongly acidic or alkaline ingredients or any other materials with a prompt injurious effect upon human tissues or the human system, they are relatively safe in use; the preferred compositions have a relatively low toxicity and in favorable cases, the $LD_{50}$ dose for human adults may be as much as about 500 ml (about 1 pint). Because they do not contain corrosive ingredients, any unintended ingestion may be remedied by the use of conventional emetics or other appropriate first aid measures.

The drain cleaner compositions are, as previously mentioned, conveniently formulated as aqueous solutions but if certain ingredients, e.g. the organic solvent, are relatively water-insoluble, the composition may be formulated as an emulsion or a dispersion, since the surfactant which is present will help to promote stability of the emulsion or dispersion. In such cases, however, it may be desirable to increase the amount of surfactant in order to ensure that sufficient amount thereof is also present for the dissolution of oil and grease in the drain clogging material. The compositions are preferably formulated as solutions in order to ensure homogeneity in production and upon use.

The compositions include an organic solvent which is effective for dissolving grease and soap scum and curds commonly found in clogged drains. A wide range of organic solvents may be used but is it preferred to use solvents of low environmental toxicity, particularly those which are relatively non-toxic to human beings. Furthermore, the preferred organic solvents are water soluble solvents such as certain lactones, pyrrolidinones and their substituted derivatives, e.g. gamma-butyrolactone.

The preferred organic solvent is N-methyl-2-Pyrrolidinone which is an active organic solvent of relatively low human toxicity, especially at the dilution levels found in the present compositions. It is effective for dissolving the grease and soap scum and curds commonly found in clogged drains and this, coupled with its low toxicity and water solubility makes it a preferred ingredient in this class. The amount of organic solvent is generally from 5 to 20, preferably 5 to 15, weight percent of the total composition. At these concentrations of the preferred solvents, it has been found that the compositions do not dissolve PVC plumbing systems to any significant extent at about 24 hours exposure and similar results with polyolefin systems would be expected.

The compositions also include an organic sulfur compound which is effective to dissolve protein fibers such as hair since this is the material most commonly found in clogged residential bathroom drains. The thioorganic compounds of this kind are known as depilatories and are frequently used in cosmetic creams and cold wave formulations for effecting a total or partial decomposition of human hair. The preferred materials of this type are the salts of mercaptocarboxylic acids, especially the salts of mercapto-acetic acid (thioglycolic acid) or 2-mercaptopropanoic acid (thiolactic acid). The alkali metal salts, especially the sodium and potassium salts, the ammonium, alkylamine, hydroxyalkylamine and alkylammonium salts and the alkaline earth salts of these acids, especially of thioglycolic acid are particularly preferred. Generally, sodium thioglycolate will be the preferred ingredient of this class from the point of view of efficiency and economy. The amount of the thioorganic compound will generally be from 1 to 10%, preferably 1 to 5%, of the total composition. Because these thioorganic compounds will generally be the most toxic of the constituents in the drain cleaner, the amount should preferably be limited to that necessary for dissolving hair and other protein fibers, generally to below 5 percent. However, if increased toxicity can be permitted, more may be used to ensure dissolution of hair clots.

A surfactant is included in the composition to aid in the dissolution of oils and greases as well as to ensure that fine particulate materials remain in suspension. Again, surfactants should preferably be selected from the point of view of human toxicity, those of low toxicity being preferred. The surfactants may be anionic, cationic or non-ionic or amphoteric and combinations of these different types of surfactants may be used if desired.

Anionic surfactants are typically organic compounds containing carboxolate, sulfonate, sulfate or phosphate polar solubilizing groups, generally in the form of their sodium, potassium, ammonium or substituted ammonium salts. Exemplary classes of anionic surfactants are the metal or ammonium carboxolates of $C_9$ to $C_{21}$ straight chain carboxylic acids, carboxylates with fluorinated alkyl chains, e.g. those marketed under the trademark Fluorad by the 3M Company and other fluorocarboxylates containing fluorinated and perfluorinated alkyl chains. In general, replacement of hydrogens on the hydrophobic portion of the molecule by fluorine atoms leads to surfactant molecules of unusually low surface tension and effectiveness and for this reason surfactants of this kind are preferred. Other anionic surfactant types include the polyalkoxycarboxylates, the N-acylsarcosinates, sulfonates, especially the alkylbenzene sulfonates, particularly those with linear alkyl side chains in the form of their sodium or ammonium salts and petroleum sulfonates produced by the sulfonation of high boiling petroleum feedstocks. Sulfates, such as the alcohol sulfates, e.g. sodium lauryl sulfate, sodium 2 ethylhexyl sulfate, sodium decyl sulfate, ethoxylated and sulfated alcohols and esters of ortho phosphoric acid are other typical anionic surfactants.

Cationic surfactants, which form a positively charged solubilizing group when dissolved in water are generally amino or quaternary nitrogen compounds, usually with low molecular weight alkyl groups such as methyl or hydroxyethyl to confer increased water solubility. Typical cationic surfactants include amines such as the aliphatic mono-, di- and polyamines derived from fatty and rosin acids, e.g. the N-alkyltrimethyline diamines where the alkyl group is derived from coconut, tallow or soybean oils; the amine oxides, ethoxylated alkylamines and alkoxylates of ethylene diamine, amino amines containing amide linkages connecting the amino group to hydrophobes, e.g. tall oil fatty acid diethylene diamines and polyalkylene polyamine condensates (other oils from which these may be derived include coconut oil, oleic acid and stearic acid) and quaternery ammonium salts such as the dialkyl dimethyl ammonium salts where the alkyl group contains about 10 to 20 carbon atoms. Generally, it is preferred not to use cationic surfactants in combination with anionic surfactants since reaction of the two large, oppositely charged ions tends to produce a salt that is insoluble in water although ethoxylation of either component will moderate this tendency.

Non-ionic surfactants which form hydrophobes carrying no discreet charge when dissolved in aqueous media may be included, for example, the polyoxyethylene surfactants such as the polyethoxylated aliphatic alcohols, alkylphenols and carboxylic acid esters, e.g. the polyoxyethylene esters of long chain fatty acids such as lauric acid, stearic acid, oleic acid and tall oil and coco fatty acids. Amphoteric surfactants may also be employed.

A particularly preferred class of surfactants are the fluorosurfactants which, as a class, are notable for their excellent wetting action, their chemical and thermal stability as well as their effectiveness at very low concentrations. They may be anionic, cationic, nonionic or amphoteric but a preferred type within this class comprises the ethoxylated alcohol type containing a perfluoroalkyl group of about 6 to 16 carbon atoms. Surfactants of this type have the typical general formula:

$$F(CF_2CF_2)_{3\text{-}8}CH_2CH_2O(CH_2CH_2O)_nH$$

where n indicates the degree of ethoxylation. Other fluorosurfactants include the anionic types such as the phosphate esters, e.g. of the formula:

$$(R_fCH_2CH_2O)_{1,2}P(O)(OX)_{2,1}$$

where $R_f$ is $F(CF_2CF_2)_{3\text{-}8}$ and X is H, $NH_4$ etc. and carboxylate types such as $$R_fCH_2CH_2SCH_2CH_2CO_2M$$

where $R_f$ is as before and M is an alkali metal, especially lithium. Cationic fluorosurfactants, e.g. quaternary ammonium compounds such as $R_fCH_2CH_2SCH_2CH_2N^+(CH_3)_3.CH_3SO_4-$ and amphoteric types such as $R_fCH_2CH(OCOCH_3)CH_2N^+(CH_3)_2CH_2CO_2-$ are also highly effective surfactants in this class. Surfactants of these types are commercially available under the Zonyl trademark from DuPont.

The surfactant is used in an amount sufficient to assist the dissolution of oleaginous components of the drain clogging materials and to maintain these materials in suspension following their dissolution. Generally, the amount of surfactant will be from 0.1 to 5%, preferably 0.1 to 2%, of the total composition, although these typical amounts will, of course, vary according to the effectiveness of the surfactant used. As mentioned above, the fluorosurfactants are particularly preferred since they are effective at very low levels of use and it has been found that less than 1%, e.g. 0.3 to 0.5%, of the preferred fluorosurfactants may be effective. The fluorosurfactants are also preferred because they work synergistically with organic solvents such as the preferred N-methyl-2-pyrrolidinone and the thioorganic compounds used to decompose the protein fibers, especially sodium thioglycolate.

A water soluble salt which increases the density of the drain cleaner composition is also used. Generally, this will be sodium chloride although other water soluble salts which will increase the density of the aqueous formulation may also be used, for example, sodium sulfate, potassium chloride, potassium sulfate or ammonium sulfate. The use of salts which will introduce cations forming insoluble products with other ingredients of the compositions should be avoided. For this reason, calcium and magnesium salts will generally not be used as densifiers because the calcium and magnesium thioglycolates and carboxymethyl celluloses are insoluble. The densifying salt is present in order to ensure that when the formation is poured into the clogged drain, it will sink through the standing water in the drain to the lowest point, where the plug is situated. Thus, salts which give the greatest relative increase in density will be preferred although it will generally be found that sodium chloride will be adequate for this purpose. The amount of the densifying salt should be selected so that upon formulation, the drain cleaner remains in the solution form; excessive amounts of the salt which might cause certain ingredients to "salt out" should therefore be eschewed and generally, the amount of the salt will be from 10 to 25, preferably 10 to 20, percent by weight of the composition, particularly for the preferred sodium chloride.

A thickener is used to increase the viscosity of the formulation in order to prevent rapid dilution in the standing water in the drain. For this purpose, the water soluble cellulose ethers such as sodium carboxymethyl cellulose, sodium carboxymethyl-2-hydroxyethyl cellulose, 2-hydroxyethyl cellulose, methyl cellulose, and the hydroxyalkyl and hydroxyalkyl alkyl celluloses are preferred, especially the salts of the carboxymethyl celluloses. Sodium carboxymethyl cellulose is an anionic cellulose ether manufactured by the reaction of monochloracetic acid, as either the acid or the sodium salt, and alkali cellulose. It is available from commercial sources as the salt as well as in the free acid form and it is non-toxic towards human beings, being physiologically inert and neither a primary irritant nor a sensitizing agent. This ingredient should be used in an amount to provide a satisfactory formulation viscosity generally in an amount from 1 to 10%, preferably about 1 to 5%, by weight of the total composition, depending upon the thickening effect of this ingredient.

Preferred finished formulations for the drain cleaner compositions will use the active ingredients in the amounts shown below (percentages by weight):

| | Broad | Preferred |
|---|---|---|
| Solvent | 5–20 | 5–15 |
| Surfactant | 0.1–5 | 0.1–2 |
| Depilatory | 1–10 | 1–5 |
| Densifier | 10–25 | 10–20 |
| Thickener | 1–10 | 1–5 |
| Water | 50–80 | 50–80 |

The preferred compositions contain N-methyl-2-pyrrolidinone as the solvent, a fluorosurfactant, sodium thioglycolate as the thioorganic compound, sodium chloride as the densifier and sodium carboxymethyl cellulose as the thickener.

Accelerators for reducing the time required for the decomposition of hair and other protein fibers may be added, for example, the alkali metal silicates, thiourea, urea, melamine, dici-yan-diamide or other conventional materials for this purpose in their conventional quantities. Corrosion inhibitors may be added although since the thioglycolates also serve to prevent corrosion in metallic drain systems, this may not be required. Sequestering agents and other material such as those used to improve consumer sensory appeal, e.g. fragrances and dyes may also be present in conventional quantities.

The drain cleaner compositions are conveniently formulated as aqueous solutions although, as previously mentioned, emulsions or dispersions are also contemplated.

EXAMPLE

The following formulation was prepared:

| | |
|---|---|
| Water | 1000 g |
| Carboxy Methyl Cellulose, Sodium salt | 30 g |
| Table Salt (NaCl) | 250 g |
| N—Methyl-2-Pyrrolidinone | 150 g |
| Surfactant, Zonyl$^R$ FSN | 5 g |
| Sodium Thioglycolate | 53 g |

Note:
Zonyl FSN is a fluoroalkyl poly(ethylene oxide) ethanol nonionic surfactant manufactured by DuPont.

Tests showed that this formulation dissolved grease plugs as fast as a commercially available caustic drain cleaner and that the formulation removed hair plugs, although not as fast as the same caustic cleaner. The formulation is non-toxic upon skin contact and oral toxicity ($LD_{50}$, adults) is approximately 500 ml.

I claim:

1. A drain cleaner composition which comprises (i) about 5 to about 20% by weight of an organic solvent selected from the group consisting of lactones, pyrrolidinones, derivatives thereof and mixtures thereof, (ii) about 1 to about 10% by weight of a thioorganic compound for decomposing protein fiber, (iii) about 1 to about 5% by weight of a surfactant, (iv) about 10 to about 25% by weight of a water soluble thickener, and (vi) about 50 to about 80% by weight of water.

2. A composition according to claim 1 in which the organic solvent is N-methyl-2-pyrrolidinone.

3. A composition according to claim 2 in which the surfactant is a non-ionic surfactant.

4. A composition according to claim 3 in which the surfactant is a fluorosurfactant.

5. A composition according to claim 4 in which the surfactant is a perfluoroalkyl polyethoxylated alcohol.

6. A composition according to claim 5 in which the densifying salt is sodium chloride.

7. A composition according to claim 6 in which the thickener is a cellulose ether.

8. A composition according to claim 7 in which the cellulose ether is sodium carboxymethyl cellulose.

9. A drain cleaner composition which comprises the following components in the following amounts by weight:

| | | Percentage |
|---|---|---|
| (i) | N—methyl-2-pyrrolidinone | 5–20 |
| (ii) | a fluorosurfactant | 0.1–5 |
| (iii) | sodium thioglycolate | 1–10 |
| (iv) | sodium chloride | 10–25 |
| (v) | sodium carboxymethyl cellulose | 1–10 |
| (vi) | water | 50–80 |

10. A drain cleaner composition which comprises the following components in the following amounts by weight:

| | | Percentage |
|---|---|---|
| (i) | N—methyl-2-pyrrolidinone | 5–15 |
| (ii) | a fluorosurfactant | 0.1–2 |
| (iii) | sodium thioglycolate | 1–5 |
| (iv) | sodium chloride | 10–20 |
| (v) | sodium carboxymethyl cellulose | 1–5 |
| (vi) | water | 50–80 |

11. A drain cleaner composition according to claim 10 which comprises the following components in the following amounts by weight:

(i) N-methyl-2-pyrrolidinone about 10%
(ii) fluoroalkyl poly(ethylene oxide)ethanol nonionic surfactant about 0.3%
(iii) sodium thioglycolate about 3.5%
(iv) sodium chloride about 17.0%
(v) sodium carboxymethyl cellulose about 2%
(vi) water about 67%.

* * * * *